United States Patent [19]

Roth et al.

[11] B 4,014,765

[45] Mar. 29, 1977

[54] METHOD FOR THE ELECTROLYTIC POLISHING OF THE INSIDE SURFACE HOLLOW NIOBIUM BODIES

[75] Inventors: Arthur Roth; Otto Schmidt, both of Erlangen, Germany

[73] Assignee: Siemens Aktiengesellschaft, Munich, Germany

[22] Filed: Feb. 28, 1974

[21] Appl. No.: 446,956

[44] Published under the second Trial Voluntary Protest Program on April 13, 1976 as document No. B 446,956.

[30] Foreign Application Priority Data

Mar. 15, 1973 Germany ..... 2313026

[52] U.S. Cl. ..... 204/129.43; 204/129.6; 204/129.7; 204/212; 204/215

[51] Int. Cl.² ..... C25F 3/30; C25F 7/00

[58] Field of Search ..... 204/129.6, 129.7, 129.43

[56] References Cited

UNITED STATES PATENTS 2,861,937 11/1958 Jumer ..... 204/212

3,616,341 10/1971 Jumer ..... 204/129.6

3,689,388 9/1972 Diepers et al. ..... 204/129.7 X

*Primary Examiner*—F. C. Edmundson

*Attorney, Agent, or Firm*—Kenyon & Kenyon Reilly Carr & Chapin

[57] ABSTRACT

A method for electrolytically polishing the inside surface of hollow niobium bodies in which the niobium body acting as an anode is partially immersed in electrolyte and a voltage applied at a current causing oscillations to take place to cause polishing of the niobium body, after which the voltage is disconnected and the oxide layer generated during polishing dissolved. In accordance with the disclosed invention, during the application of the constant voltage, the hollow niobium body is slowly rotated about its axis of rotation at a speed so low that the development of the damped oscillations is not disturbed, with the rotation stopped during the subsequent dissolution of the oxide layer and then a further rotation carried to immerse parts which have not been previously polished after which the steps are repeated.

9 Claims, 3 Drawing Figures

METHOD FOR THE ELECTROLYTIC POLISHING OF THE INSIDE SURFACE HOLLOW NIOBIUM BODIES

BACKGROUND OF THE INVENTION

This invention relates to the electrolytic polishing of the inside surfaces of hollow niobium bodies in general, and more particularly to an improved method of carrying out such polishing.

As disclosed in U.S. patent application Ser. No. 289,543 filed Sep. 15, 1972 and assigned to the same assignee as the present invention, the inside body of a hollow niobium body having at least one opening, can be polished by immersing the niobium body partially in an electrolyte containing $H_2SO_4$, HF and $H_2O$. The niobium body acting as an anode is arranged rotatably about an axis of rotation extending through the opening such that for any position of the hollow niobium body, a coherent empty space exists, which is in communication with the outside environment through the opening of the body. Thus, all portions of the body between the electrolyte level and the inside of the hollow body are in communication with the outside environment. To carry out polishing, individual parts of the inside surface are successively immersed in the electrolyte but with no part of the inside surface remaining continuously therein. Electrolytic polishing is accomplished through the use of a cathode introduced through the opening into the hollow niobium body and arranged in the electrolyte in such a manner that the region of the electrolyte in which gases are formed at the cathode during current flow, rise to the surface of the electrolyte to an area free of parts of the inside surface of the hollow niobium body so that they may escape the outside environment. In addition, in carrying out this polishing, a constant electric voltage is applied across the hollow niobium body acting as an anode and the cathode with the electric voltage being such that damped current oscillations are superimposed on the electrolyte current. In addition, the voltage is switched off no later than at the point of complete decay of the current oscillations to permit the oxide layer which was built up during the oscillations to be dissolved. Thereafter, the constant voltages again applied resulting in damp current oscillations, another step of dissolving performed and so on, with the steps repeated several times. In each case, the hollow niobium body is kept at rest during dissolution of the oxide layer and is then rotated about the axis of rotation before voltage is again applied.

In basic terms, this method of electrolytic polishing of niobium parts is disclosed in U.S. Pat. No. 3,689,388. As described in detail therein, the electrolyte used consists of 86 to 93 % by weight of $H_2SO_4$, 1.5 to 4.0% by weight of HF and 5.5 to 10.0% by weight of $H_2O$ at a temperature of between 15° and 50°C, in a constant voltage of between 9 and 15 V applied to obtain damped current oscillations.

After repeating the above described steps a number of times, an excellent polishing effect is observed at the niobium surface. The oxide layer which builds up causes the oscillations to decay. Deviations of about ± 0.1 V from the adjusted voltage are permissible in this method. Once the voltage is switched off, the oxide layer dissolves and current oscillations again become possible when the voltage is once again swiched on. As is described in the above referenced patent, the voltage must be switched off no later than at the point of complete decay, since otherwise, the niobium surface will be etched and new surface roughness generated. The repetition of the steps results in a final product having mirror-like surfaces which can be obtained in a relatively short time. In addition, through repetition of the steps, relatively thick layers of the surface can be removed without troublesome etching. The voltage can be switched off before current oscillations have completely decayed. However, in order to get maximum benefit from the polishing action during current oscillations, the voltage should not be switched off before the maximum amplitude of the current oscillations has passed. The optimum voltage will vary, depending on the composition and temperature of the electrolyte and can be determined through experiment by increasing the voltage until the desired oscillations occur. In the above referenced patent, it has been found particularly advantageous to use an electrolyte consisting of 89.0 to 90.5% by weight $H_2SO_4$, 2.2. to 3.0 % by weight HF and the rest $H_2O$ at a temperature of 20° to 35°C and to use a constant voltage of between 11 and 13 V. With these conditions, particularly fast current oscillations occur, resulting in particularly good polishing effects.

The method of this patent is quite well suited for the preparation of mirror-smooth niobium surfaces of high surface quality and for removing entire surface layers while at the same time obtaining a polishing effect. Such surfaces are required, for example, in superconducting cavity resonators made of niobium, in which the superconductivity of niobium is used. Mirror-smooth surfaces are a great advantage in these types of devices in order to avoid high frequency or a-c losses in the superconducting niobium parts. This is also true, in particular, for superconducting niobium separators or particle accelerators and niobium conductors used in superconducting a-c cables.

Although smaller niobium parts of simple geometric shape can be electrolytically polished using the method described in U.S. Pat. No. 3,689,388 with ease, problems arise when attempting to polish the inside surface of hollow niobium bodies, in particular due to the fact that the development of gases during the electrolytic action and which rise from the cathode in the electrolyte can have a disturbing effect on the process. In particular, with hollow niobium bodies of a complicated geometrical structure, gas pockets can be formed resulting in portions of the inside surface of the niobium body not being wetted by the electrolyte and thus, not polished. In addition, the gas bubbles which flow directly along the inside surfaces of the hollow body and come into contact therewith, have a disturbing effect and can result in the supression or reduction of the oscillations required for good polishing.

A method for overcoming these difficulties has been disclosed in U.S. Pat. No. 289,543 filed on Sept. 15, 1972 and assigned to the same assignee as the present invention. In the method disclosed therein, the hollow niobium body is only partially immersed in the electrolyte and is rotatably arranged about an axis of rotation extending through the opening such that, for any position of the body, a coherent empty space in communication with the outside environment exists. As a result between the surface level of the electrolyte and all parts of the inside surface of the hollow body which are located above the electrolyte level, direct communication with the outside exists.

The hollow body is rotated so that the individual parts of the inside surface are successively immersed in the electrolyte in such that no part remains continuously therein. The cathode is introduced in the opening in the hollow niobium body and arranged in the electrolyte, relative to the hollow body, such that region of the electrolyte in which gases are formed upon passage of current permits the gases to rise to the surface of the electrolyte with the area thereabove free of parts of the inside surface of the hollow niobium body so that the gas may escape. In this method, the hollow niobium body is kept at rest during the dissolution of the oxide layer and after dissolution is rotated. The body is then stopped and a constant voltage applied again with the body at rest. These steps of applying voltage to obtain oscillation while at rest, then dissolving while still at rest, followed by a rotation, result in polishing of the entire surface without the problems associated with heavy gas development. The gas rises without touching any of the parts being polished and escapes from the empty space above the electrolyte level through the opening.

Although the method disclosed in this application makes an attempt at avoiding the formation of steps during the process, which steps result from the manner of rotation and the fact that the body remains at rest during the application of voltage and dissolution of the oxide layer, the formation of steps cannot be completely prevented at the point where the electrolyte level contacts the inside surface.

Thus, it can be seen that there is a need for an improved method of polishing which has the advantages of these previous methods, but avoids the formation of such steps.

SUMMARY OF THE INVENTION

The present invention achieves such polishing through the additional step of slowly rotating the body during the application of a constant voltage. The body is rotated about its axis of rotation at a speed which is sufficiently low that it does not affect the development of damped oscillations.

Although it was always assumed that rotation of the hollow niobium body while voltage was being applied would prevent current oscillations, it has been discovered that if the rotation is maintained sufficiently slow, these oscillations are not disturbed. Thus, through an extremely slow rotation, oscillations are maintained, while at the same time, the point at which the electrolyte level contacts the inside surface during polishing is gradually shifted and the development of steps avoided.

In general terms, according to the method of the present invention, the development of damped oscillations is not impaired as long as the speed of rotation is so low that the development of the oxide layer at the inside surface of the hollow niobium body is not impaired by an excessive flow velocity of the electrolyte. More specifically, it has been found that if the hollow niobium body is rotating during a voltage application of from 0.7 to 4 min duration that the width of the zone of the inside surface emerging from the electrolyte from the beginning to the end of this period should be at most 5 mm.

If the niobium body has a small diameter, this value should not exceed 3mm. In particular, if the rotation is such that between about 1 and 3 mm has emerged at the time of switching off the voltage, particularly good results are obtained. The rotation may be continuous during the application of the constant voltage or may be done in a step wise manner.

The zone which emerges from the electrolyte will be covered with an oxide layer which is tappered, the first portion to have been rotated out of the electrolyte being thinner, and the latter portion having a layer approximately of the thickness of the layer on that portion immersed in the electrolyte. According to a further embodiment of the present invention, the electrolyte level is raised by at least the width of the zone during the dissolving step which follows the voltage application step. In this manner, the electrolyte will reach the upper edge of the zone and dissolve the oxide layer thereon. In this manner, all parts of the body which are subsequently immersed for another polishing step, will be free of oxide.

It is, however, possible to carry out the present invention without a raising of the electrolyte. In such a case, the hollow niobium body should be rotated during the application of voltage at a rate such that no more than 3% of the area situated within the electrolyte emerges. If this method is followed, and along therewith is then rotated each time by approximately 180° about the axis of rotation after dissolution and before application of a constant voltage again, only a small portion of the inside surface immersed in the electrolyte will be covered with a niobium oxide layer and current oscillations will not be impeded. When operating in this manner, it is even more favorable if the hollow niobium body is rotated at a rate such that no more than 2% of the area of the portion immersed in the electrolyte emerges.

Much in the manner of the method disclosed in the above identified U.S. patent application, Ser. No. 289,543, the rotation angle between steps is chosen in order to obtain a polishing action as uniform as possible. That is, it is chosen so that as far as is possible, all portions of the inside surface are immersed for equal times during the polishing process. This can be achieved in a particularly simple manner, where the axis of rotation lies in a plane described by the electrolyte surface level, with an angle of rotation of about 180°. Because of the slowness of the rotation during the voltage application, the electrolyte level will always lie at a different point of the inside surface after advancing 180°. This avoids the formation of etching grooves. As disclosed in connection with the preferred embodiment, when polishing niobium bodies of rotational symmetry, the axis of rotation will advantageously coincide with the axis of symmetry of the body.

During the dissolution of the oxide layer, the electrolyte inside the hollow niobium body will preferably be replaced by circulation. In particular for the case of the hollow niobium bodies of complicated geometrical shape, such a flow accelerates the dissolution of the oxide layer. In addition, such a flow reduces any concentration variations within the electrolyte which can occur due to the relatively small volume of electrolyte within the hollow niobium body as compared to the total volume of electrolyte being used.

DETAILED DESCRIPTION OF THE PREFERRED EMBODIMENT

Figures 1, 2:
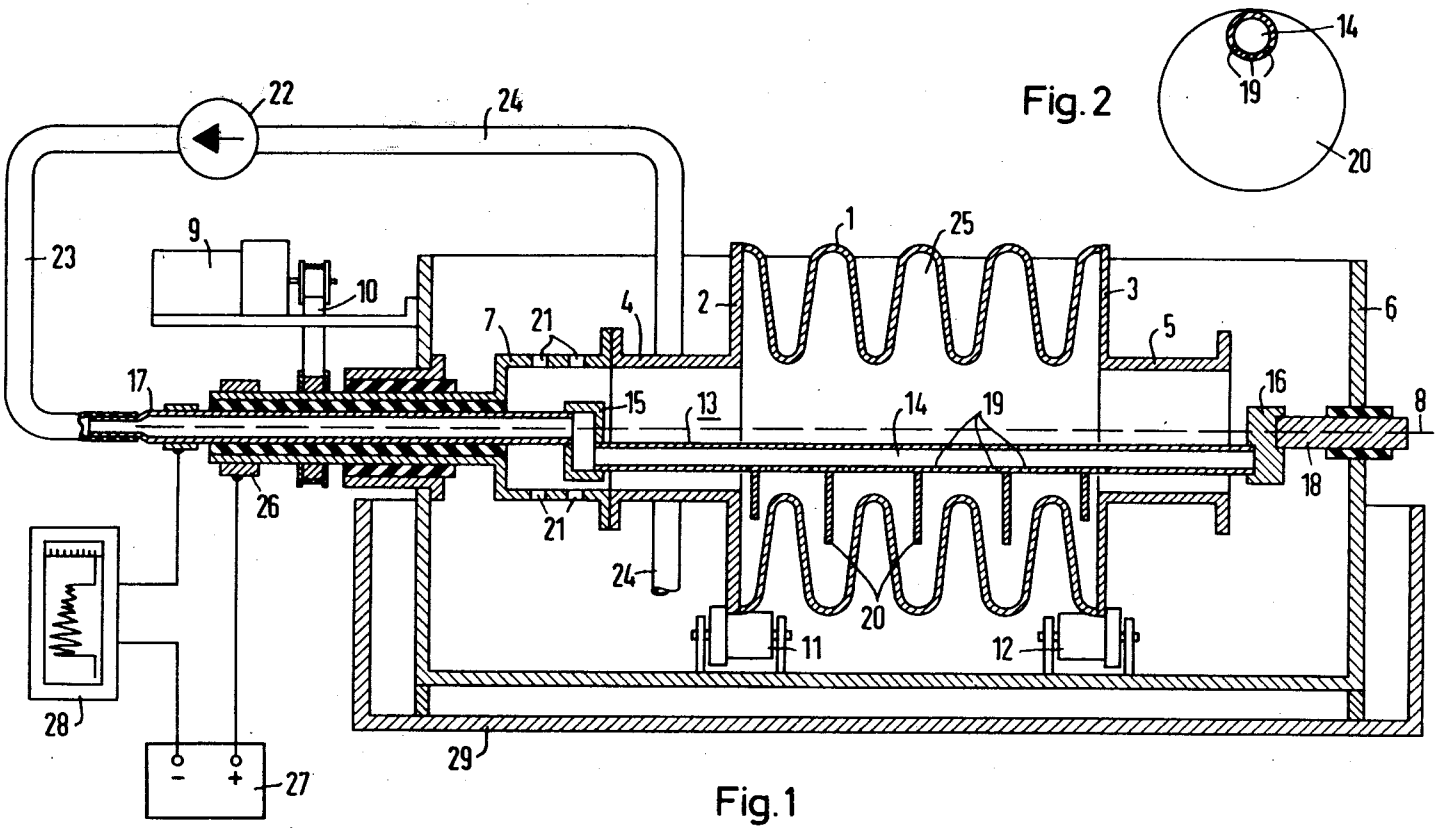
FIG. 1 is a cross sectional schematic view of a preferred apparatus for carrying out a method of the present invention.
FIG. 2 is a view illustrating the cathode used in the apparatus of FIG. 1.

Illustrated on the FIGS. is a hollow niobium body 1 and the apparatus used in polishing it, according to the method of the present invention. This niobium body 1 of a relatively complicated shape, is a type $HEM_{011}$ separator structure for particle accelerators. It is provided on each end with niobium covers designated 2 and 3, having respective tubular niobium extensions 4 and 5. The niobium body 1 is supported for rotation within an electrolyte tank 6 by attachment of the tubular extension 4 to a flange 7. The tubular extension 4, as illustrated, has a flange on its end which permits bolting of the hollow niobium structure to the flange 7. The flange 7 has a shaft which is brought through one wall of the electrolyte tank 6 in an electrically insulated and electrolyte-tight manner and is rotatably supported about an axis of rotation 8 in the wall. For the example of FIG. 1, the axis of rotation 8 coincides with the axis of rotational symmetry of the hollow niobium body 1. A motor 9 is coupled by means of a belt 10 to the shaft portion of the flange 7 to impart rotation thereto. As is more clearly illustrated by FIG. 3, plastic rollers 11 and 12 in the bottom of the tank provide additional support for the hollow niobium body as it rotates. In place of these, a second tubular flange, such as flange 7 and supported in suitable bearing means, may be installed in the other end of the tank 6 and coupled to the tubular extension 5.

Figure 3:
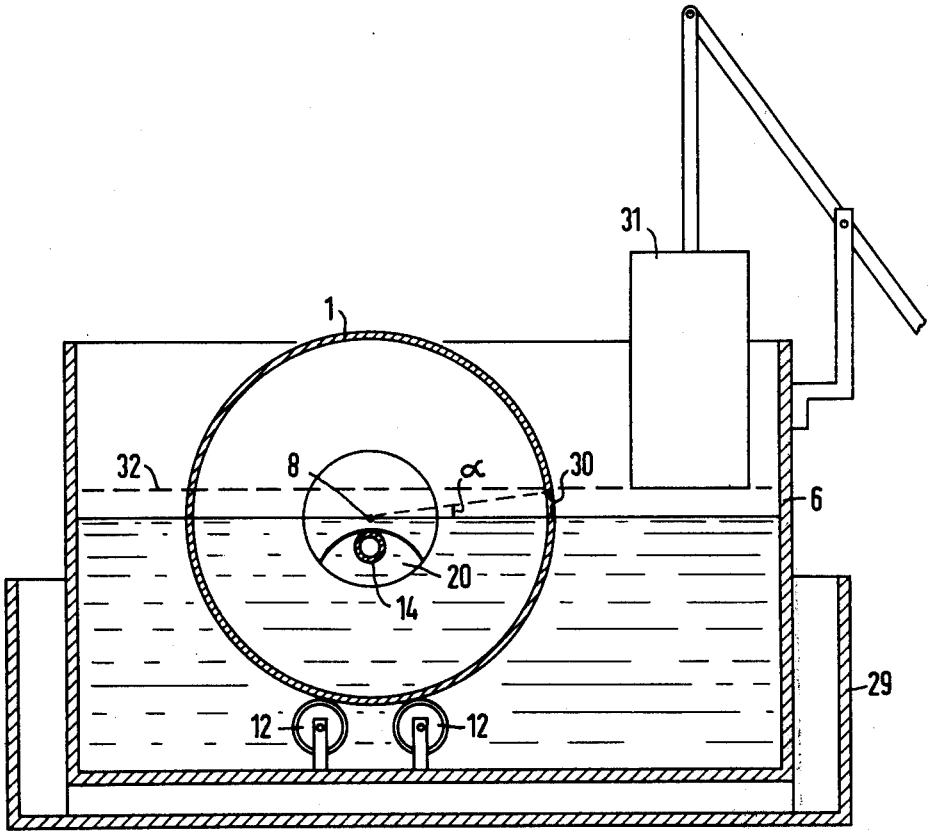
FIG. 3 is a cross sectional end view through the apparatus of FIG. 1.

The cathode 13 is made up of several parts. It includes a portion 14 placed inside the hollow niobium body 1 and displaced downwardly with respect to the axis of rotation 8. The portion 14 is connected through connecting members 15 and 16 respectively, with the parts 17 and 18. These are parts which are electrically insulated from the flange 7 and are brought through the walls of the electrolyte tank 6 in an electrolyte tight manner. The cathode 13 is stationary and thus, does not co-rotate with the flange 7. Parts 14, 15 and 17 are of tubular shape. The part 14, which is shown in cross section on a large scale in FIG. 2, is provided with a plurality of holes 19 on its lower side. It also has attached to it, a plurality of disc-shaped extensions 20 which protrude into the bays of the wall of the hollow niobium body 1. Through the use of the extensions 20, an approximately uniform current density can be achieved along the inside surface of the hollow niobium body despite the deep cavities. In addition, the wall of the flange 7 has provided along its entire circumference, holes 21 at the end next to the hollow niobium body. A pump 22 is installed which is connected to one end of the part 17 using a hose 23 or the like. Another hose 24 is placed in the tank 6 and used to draw electrolyte therefrom. Through use of the pump 22, electrolyte is circulated from the electrolyte tank 6 and provided into the cathode 13. The electrolyte then flows through the openings 19 in the part 14 of the cathode into the interior of the hollow niobium body. Excess electrolyte can flow out of the interior of the hollow body 1 through the openings 21 in the stub 7, and also, in the embodiment shown on FIG. 1, through the open end of the tubular extension 5.

When operating the apparatus according to the present invention, the electrolyte tank 6 is filled with electrolyte to approximately the axis of rotation 8. With such an arrangement, as is clear from an examination of FIG. 1, the gases formed at the cathode can rise into the empty space 25 above the electrolyte level without touching any portions of the inside surface of the hollow niobium body which is immersed in the electrolyte. These gases can then flow unimpeded through the openings 21 in the wall of the flange 7 and also through the open tubular extension 5. The flange 7 also provides an electrical connection for the hollow niobium body 1, which is to act as the anode. Thus, the end of flange 7 is connected by means of slip rings 26 to the positive terminal of a constant voltage source 27. Similarly, the part 17 is connected to the negative terminal of the voltage source 27. A chart recorder is coupled into this connecting line which permits the recording and simultaneous monitoring of the current oscillations occurring during polishing. Also shown, is an additional tank 29, enclosing the electrolyte tank 6 and which can have cooling water flowing therein for maintaining the electrolyte temperature.

The tank 6, tubular flange 7, cathode 14, along with other metal parts that are in contact with the electrolyte will preferably be made of high-purity aluminum. The plastic for the rollers 11 and 12 and the insulating plastic parts at the feedthroughs of the cathode 13 and flange 7 through the walls of tank 6 may be made of polyethylene. Seals can be sealing rings, for example, of Viton. These sealing rings, which will be used in conventional fashion to maintain an electrolyte seal, are not shown in detail on FIG. 1 for sake of clarity.

The method of the present invention will be explained in more detail through the following example.

EXAMPLE

A niobium separator 1 with covers 2 and 3 and tubular extensions 4 and 5 and the inside surface of which is to be polished, will have, for example, a maximum inside diameter of 130 mm and at the narrowest point, a smallest inside diameter of about 40 mm. The length of the niobium separator 1 including tubular extensions 4 and 5, is about 300 mm. The separator is first placed in the tank, in the manner shown on FIGS. 1 and 3. The tank 6 is then filled with electrolyte, until the electrolyte reaches the axis of rotation 8. A preferable electrolyte is a mixture of 90% by volume of 96% sulfuric acid and 10% by volume of 40% hydrofluoric acid. This mixture corresponds to a composition of about 89.8% by weight $H_2SO_4$, 2.6 % by weight HF and 7.6% by weight $H_2O$. The bath temperature is maintained constant at, for example, 28°C. A total volume of the electrolyte in the apparatus is about 5 liters. A voltage of 12.5V is applied between the anode and cathode, using the constant voltage source and held constant to within $\pm$ 0.05 V. As soon as the voltage is applied, damped current oscillations which are superimposed on the electrolyte current occurs. Their amplitude rises rapidly, after a buildup transient, to a maximum value and then slowly decays. In carrying out the present example, the mean current is about 50 A and maximum amplitude of oscillations superimposed on the current about 10 A. Oscillations occur at a rate of about 20 oscillations per minute. The constant voltage is maintained for approximately 1.5 minutes, with the niobium body 1 rotated slowly through an angle $\alpha$ about the axis of rotation, at such a speed that at the end of voltage application, the width of the zone 30 emerging from the electrolyte at the inside surface of the niobium cavity is about 2mm. This rotation can be continuous or can also be made in a number of small steps, for example, 20 small steps to make up a total angle $\alpha$. In such a case, intervals of several seconds should be interposed between each of the steps. Such is achieved by switching the motor 9 on and off at the required rate and without the need for a gear box. That is, if continuous rotation is used, gearing down of the motor to the slow speed is necessary. This slow speed will result in a loss of time, when later effecting a large rotation. Thus, a two speed arrangement is preferable. On the other hand, if stepping is used, the same motor speed can be used at all times, and the amount of motion controlled by the amount of time the motor is turned on. After the above noted time of 1.5 minutes, after which the maximum amplitude of current oscillations has passed, the voltage is switched off for approximately 7 minutes, in order to allow the oxide layer, which has been formed during the oscillations and which will probably consist of $Nb_2O_5$, to dissolve. During this interval of 7 minutes, the niobium body 1 is maintained at rest and the electrolyte is circulated at a rate of about 1 liter/min. Preferably, the electrolyte level will be raised to the level 32 shown on FIG. 3 through the use of a displacement body 31 being immersed in the electrolyte, causing the electrolyte to cover the entire zone 30 which has emerged from the electrolyte during the preceding polishing step. After dissolution, the electrolyte level is again lowered and the niobium cavity rotated, for example, by an angle of rotation of about 180° about the axis of rotation 8. The niobium surface which is now immersed, will be free of an oxide layer. The constant voltage of 12.5 V is again applied between the anode and cathode for 1.5 minutes with the hollow niobium body again slowly rotated during this period. In the manner described above, polishing takes place with the portion of the body not polished during the first step, now being polished. Thereafter, the voltage is again interrupted, the electrolyte level raised and dissolution of the oxide layer takes place. The niobium body is again advanced 180° and these steps continued. In each polishing step, a layer of approximately 1.5 $\mu$is removed from the inside of the niobium cavity *q*. Thus, if the removal of 150 $\mu$is desired, each half of the inside surface of the body must be polished approximately 100 times in accordance with the method of the present embodiment so that, with an angular rotation of 180° after each polishing step, a total of 200 polishing steps are required.

The raising of the level to dissolve the oxide layer can be omitted in the manner described above, if the limitations given are followed. In such a case, when the body is rotated 180° after the dissolution of the oxide layer, the zone designated 30 on FIG. 3, and which will contain an oxide layer, will again be immersed in the electrolyte. This will not, however, disturb the damped current oscillations, since for the given dimensions, the area of the zone is only about 1% of the area of the part inside the hollow niobium body 1 immersed in the electrolyte.

The duration of voltage application need not be exactly 1.5 minutes, but can be varied, for example, between 0.7 and 2 minutes. During this time, the hollow niobium body 1 will preferably be rotated a distance, such that the width of the zone emerging from the electrolyte is approximately 1 to 3 mm. Furthermore, the time during which the voltage is switched off may be less than 7 minutes, e.g., only 6 minutes, and may also be longer. Similarly, somewhat different electrolyte compositions, bath temperatures and voltages are possible, as is more fully described in conjunction with the method of U.S. Pat. No. 3,689,388.

It should also be noted that the method of the present invention which furnishes extremely smooth niobium surfaces without steps, can be automated in a simple manner. In the simplest case, the switching on and off of the voltage, the rotation of the hollow niobium body and the circulation of the electrolyte can take place according to a fixed preset program.

Thus, an improved method for polishing the inside surfaces of hollow niobium bodies has been described. Although a specific set of steps has been described, it will be obvious to those skilled in the art that various modifications may be made without departing from the spirit of the invention, which is intended to be limited solely by the appended claims.

What is claimed is:

1. A method for the electrolytic polishing of the inside surface of a hollow niobium body, having at least one opening, in which method the hollow niobium body is partially immersed in an electrolyte, containing $H_2SO_4$, HF and $H_2O$, the niobium body being the anode in the electrolyte and supported for rotation about an axis of rotation extending through the opening such that for any position of the hollow niobium body, a coherent empty space in communication with the outside environment through the opening is present, said empty space being formed between the surface level of the electrolyte and all parts of the inside surface of the hollow niobium body located above the electrolyte level, in which method a cathode is introduced through the opening in the hollow niobium body and arranged in electrolyte relative to the hollow niobium body such that in the region of the electrolyte in which gases formed at the cathode during the flow of current are free to rise to the surface of the electrolyte and escape from the inside surface of the hollow niobium body without contacting any parts of the inside surface of the hollow niobium body immersed in the electrolyte, the steps of polishing including applying a constant electric voltage between the hollow niobium and the cathode such as to obtain damped oscillations imposed on the electrolyte current, switching off the voltage no later than at the point of complete decay of the current oscillations, maintaining the niobium body at rest until the oxide layer built up during the current oscillations is dissolved, rotating the niobium body and repeating these steps with the individual parts of the inside surface successively immersed in the electrolyte but such that no part of the inside surface remains continuously in the electrolyte, wherein the improvement comprises slowly rotating the hollow niobium body during a period of constant voltage application of approximately 0.7 to 4 minutes about its axis of rotation at a speed which is sufficiently low so that the width of the zone of the inside surface which has emerged by the time the voltage is switched off is is at most 5 mm so as to not disturb the development of the damped oscillations, and raising the level of the electrolyte after the voltage is switched off to cover at least the zone which has emerged during application of voltage whereby the full oxide layer formed will be dissolved.

2. The method according to claim 1 wherein said zone is at most 3 mm.

3. The method according to claim 2 wherein the width of said zone is between 1 and 3 mm.

4. The method according to claim 3 wherein said rotation is continuous during the application of a constant voltage.

5. The method according to claim 3 wherein said rotation during the application of a constant voltage is accomplished in small steps.

6. The method according to claim 1 wherein said rotation is continuous during the application of a constant voltage.

7. The method according to claim 1 wherein said rotation during the application of a constant voltage is accomplished in small steps.

8. A method for the electrolytic polishing of the inside surface of a hollow niobium body, having at least one opening, in which method the hollow niobium body is partially immersed in an electrolyte, containing $H_2SO_4$, HF and $H_2O$, the niobium body being the anode in said electrolyte and supported for rotation about an axis of rotation extending through the opening such that for any position of the hollow niobium body, a coherent empty space in communication with the outside environment through the opening is present, said empty space being formed between the surface level of the electrolyte and all parts of the inside surface of the hollow niobium body located above the electrolyte level, in which method a cathode is introduced through the opening in the hollow niobium body and arranged in electrolyte relative to the hollow biobium body such that in the region of the electrolyte in which gases formed at the cathode during the flow of current are free to rise to the surface of the hollow niobium body without contacting any parts of the inside surface of the hollow niobium body immersed in the electrolyte, the steps of polishing including applying a constant electric voltage between the hollow niobium body and the cathode such as to obtain damped oscillations imposed on the electrolyte current, switching off the voltage not later than at the point of complete decay of the current oscillations, maintaining the niobium body at rest until the oxide layer built up during the current oscillations is dissolved, rotating the niobium body and repeating these steps with the individual parts of the inside surface successively immersed in the electrolyte but such that no part of the inside surface remains continuously in the electrolyte, wherein the improvement comprises slowly rotating the hollow niobium body during the period of constant voltage application about its axis of rotation at a speed which is sufficiently low such that the area which has emerged after the voltage is turned off is no more than 3% of the area immersed in the electrolyte so as to not disturb the development of the damped oscillations.

9. The method according to claim 8 wherein said emerged area is less than 2% of said immersed area.

* * * * *